US005823450A

United States Patent [19]

Folsberg

[11] Patent Number: 5,823,450

[45] Date of Patent: Oct. 20, 1998

[54] RING ROLLER MILL

[75] Inventor: Jan Folsberg, Copenhagen, Denmark

[73] Assignee: F.L. Smidth & Co. A/S, Denmark

[21] Appl. No.: 20,289

[22] Filed: Feb. 6, 1998

Related U.S. Application Data

[63] Continuation of Ser. No. 571,938, Jan. 5, 1996, Pat. No. 5,716,015, continuation of PCT/EP94/02503 Jul. 27, 1994.

[30] Foreign Application Priority Data

Aug. 2, 1993 [DK] Denmark ..... 0893/93

[51] Int. Cl.[6] ..... B02C 17/10

[52] U.S. Cl. ..... 241/47; 241/79; 241/122

[58] Field of Search ..... 241/47, 54, 79, 241/122

[56] References Cited

U.S. PATENT DOCUMENTS

| | | | |
|---|---|---|---|
| 1,220,155 | 3/1917 | Fraser | 241/122 X |
| 1,693,247 | 11/1928 | Molz . | |
| 1,831,625 | 11/1931 | Hardinge . | |
| 1,938,045 | 12/1933 | Schmidt . | |
| 3,537,658 | 11/1970 | Jurgen Janich | 241/54 X |
| 3,614,002 | 10/1971 | Dore | 241/51 |
| 5,649,667 | 7/1997 | Folsberg | 241/47 |
| 5,716,015 | 2/1998 | Folsberg | 241/47 |

*Primary Examiner*—John M. Husar
*Attorney, Agent, or Firm*—Baker & Botts, L.L.P.

[57] ABSTRACT

The present invention relates to a ring roller mill which, among other things, can be used in connection with the manufacture of cement for grinding of mineral clinker materials, slags, and similar materials. The mill has a grinding ring 1 and a roller 2. Between the roller 2 and the grinding ring 1, the partially crushed material forms a grinding bed 4 and on each side of the grinding ring 1 dam rings 5 are fitted. On the outer side of the dam rings 5 are fitted collecting jackets 6, to which scoop plates 7 are fixed. The jacket collects the material which flows over the dam ring and by means of the scoop plates the material is lifted round with the collecting jacket. Since the speed of the jacket is lower than the critical speed, the material will drop off from the uppermost part of the jacket, being dispersed towards the bottom of the latter, and is subsequently returned to the grinding path. Effective internal conveyance is achieved with the mill according to the invention, hence eliminating the need for any external conveyance of overflow material.

7 Claims, 2 Drawing Sheets

RING ROLLER MILL

This is a continuation of Ser. No. 08/571,938, filed Jan. 5, 1996, now U.S. Pat. No. 5,716,015 and a continuation of PCT/EP94/02503 Jul. 27, 1994.

BACKGROUND OF THE INVENTION

The present invention relates to a ring roller mill which comprises at least one grinding ring and at least one roller, which crushes material against the inner periphery of the grinding ring. Such a mill can, for example, be used in connection with the manufacture of cement for grinding of mineral clinker materials, slags, and similar materials.

EP-A-0486371 discloses a ring roller mill in which conveyance of material is accomplished by the feed material being charged to a compartment before the grinding path where it is subjected to centrifugal action, whereafter the material is carried in an airstream axially through the mill. The grinding ring in this mill is rotating at a supercritical speed, and it is therefore necessary to mount scrapers internally in the ring in order to release the material during passage transversely to the grinding ring. These scrapers can be tilted so that they guide the material forward along the roller in the flow direction. After the passage through the grinding path, a coarse fraction is extracted from the bottom of the mill and passed through a screen, and from the top of the mill a fine fraction is directed to a separator. There is no internal recirculation in this mill, and the fractions which pass through the mill without being sufficiently ground are recirculated externally.

SUMMARY OF THE INVENTION

It is the object of the present invention to provide a ring roller mill with an effective internal conveying system, thereby eliminating the need for any external conveyance of overflow material, and thus producing substantial operational and plant design savings, not just because of the omitted conveyors, but also because the ring roller mill itself can be mounted directly at the ground level, hence eliminating the need to mount it at an elevated level to ensure proper discharge.

According to the invention, a ring roller mill comprising at least one grinding ring and at least one roller is characterized by at least one outlet opening for material suspension provided within, and offset radially from, the axis of, the grinding ring; by at least one air inlet opening on each side of the outlet opening in the rotational direction of the grinding ring, at least one axial end of the grinding ring being fitted with a collecting jacket which constitutes an extension of the grinding ring and with a stationary end section; by radially inwardly directed scoop plates fitted at intervals around the collecting jacket; and by means for rotating the collecting jacket at a speed below the critical speed (as herein defined).

The jacket collects the material which passes axially out of the grinding ring, e.g. over a dam ring and by means of the scoop plates the material is lifted around with the collecting jacket. Since the speed of the jacket is lower than the critical speed, i.e. the speed at which the material is not detached from the jacket, but is carried along all the way, the material will drop off from the uppermost part of the jacket and be dispersed towards the bottom of the latter, whereafter it is returned to the grinding path.

At several locations in the collecting jacket, guide plates which guide the dropping material towards the grinding track may be fitted internally in the mill and/or the dropping material may be blown towards the grinding track via air from the air inlet openings through which the feed material is introduced to the mill.

The angle v between the surface of the scoop plates and the tangent to the periphery of the ring upon which the plates are mounted may be varied ($0° < v < 180°$). The optimum location and profile of the scoop plates will depend on the speed of the ring and on the types of materials being ground in the mill.

In a special embodiment of the ring roller mill, the scoop plates are more or less backwardly inclined relatively to the rotational direction, so that the collected material is prevented from sticking to the scoop plates instead of dropping back towards the grinding path.

Thus, it would be particularly advantageous to use the present invention in connection with a mill of the type which is described in the Danish patent application No. 748/93, where the air inlet and outlet ducts are symmetrically configured at both ends of the mill. Here, an appropriately even material distribution along the roller length is obtained in combination with a low air velocity which will facilitate the material conveyance out of the mill.

Preferably, end sections provided with similar inlet and outlet openings are located at each axial end of the grinding ring.

Conveniently, the outlet opening in the or each end section is formed in an area above the roller where the distance between grinding ring and roller is greatest, and in that the air inlet openings are symmetrically located relative to the or each outlet opening.

BRIEF DESCRIPTION OF THE DRAWINGS

The invention will now be explained in further detail with reference to the accompanying drawings in which.

DESCRIPTION OF THE PREFERRED EMBODIMENT

Figure 1:
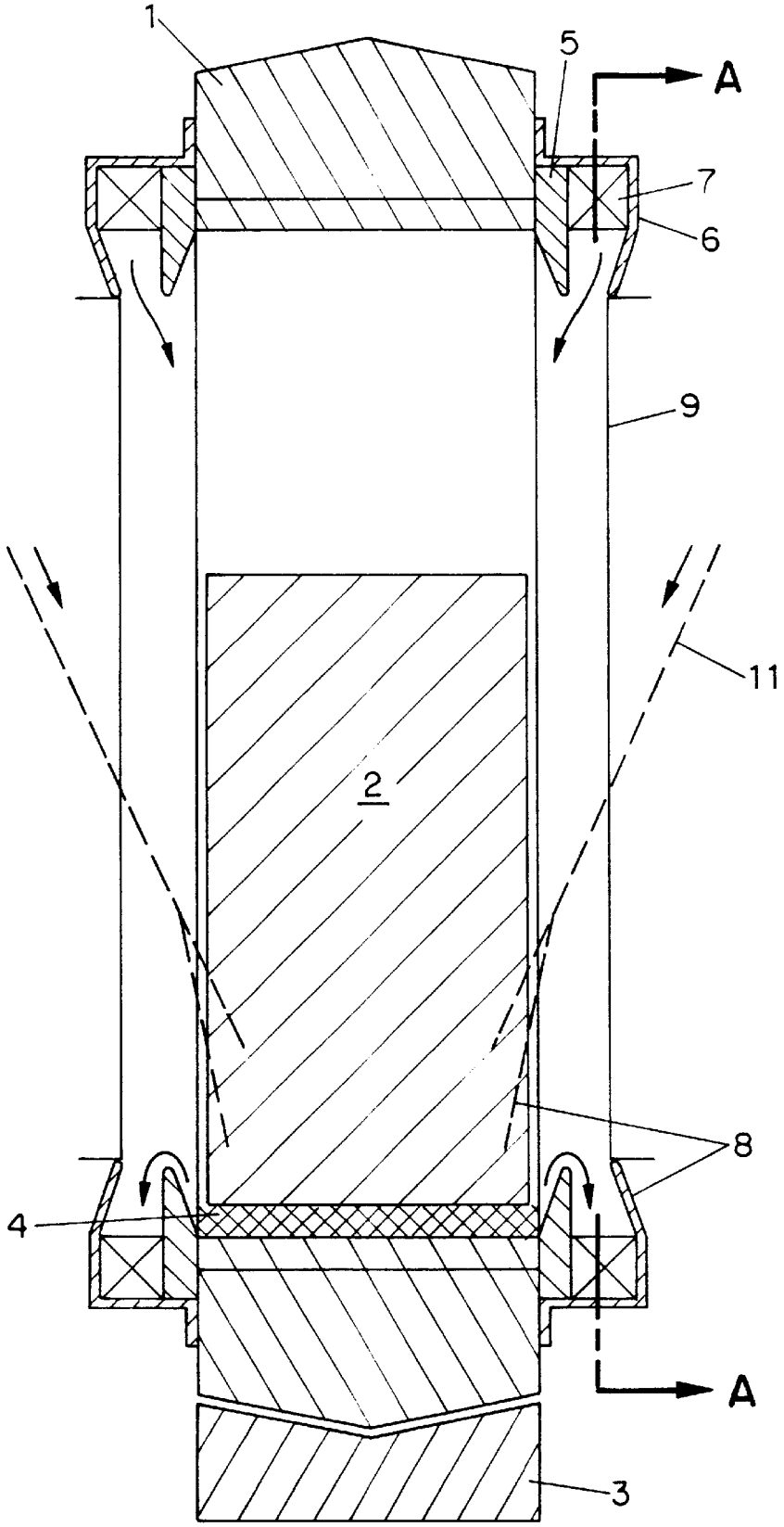
FIG. 1 is an axial section through a ring roller mill according to the invention; and, FIG. 2 shows a section taken on the line A—A in FIG. 1.
Figure 2:
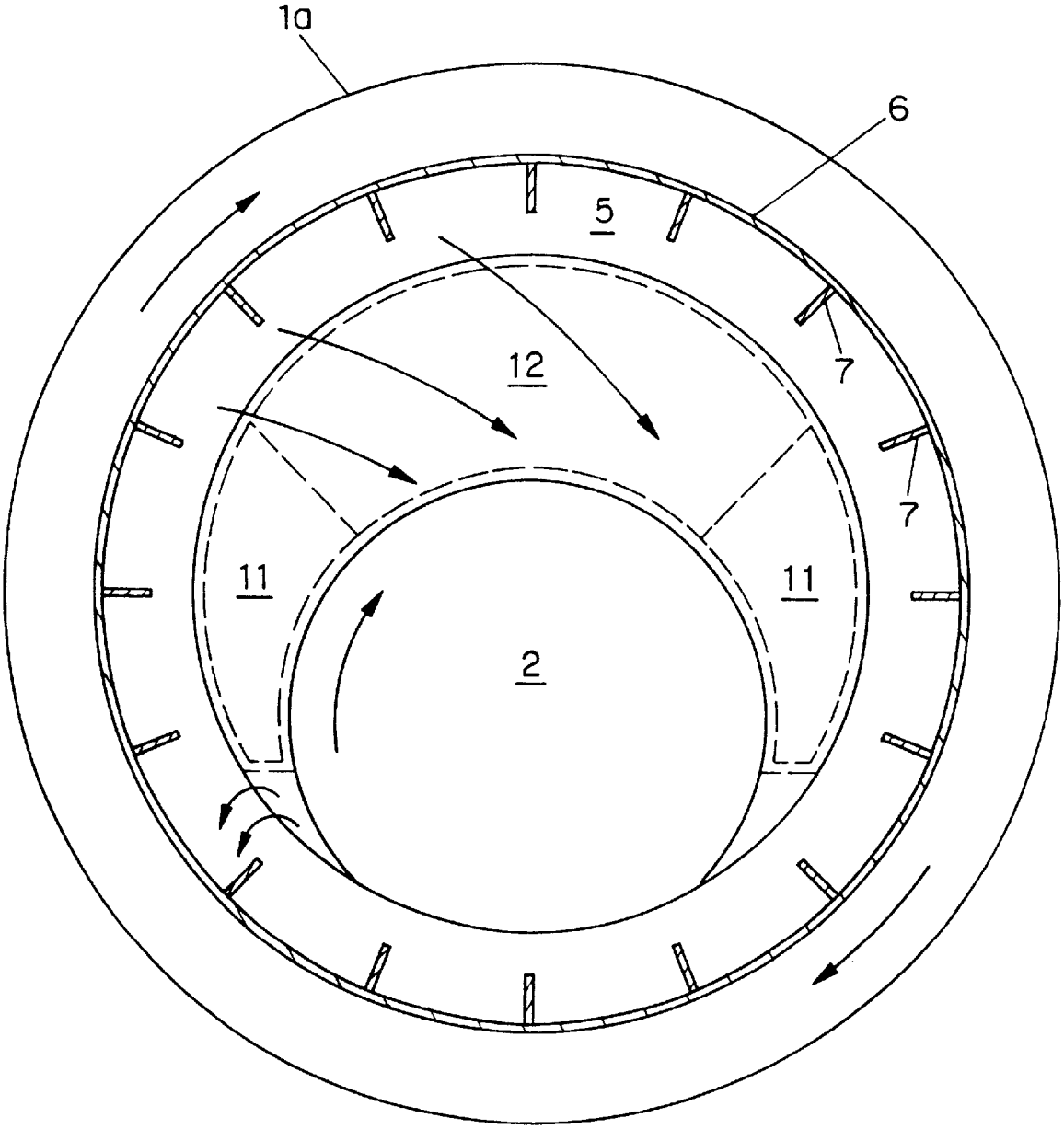

The mill in FIG. 1 has a grinding ring 1 and a roller 2. The roller 2 and the grinding ring 1 are rotated by means of not shown driving means. The grinding ring 1 is running in a fixed thrust bearing 3 and the roller 2 is thrust against the grinding ring 1 by means of a not shown tensioning system.

Between the roller 2 and the grinding ring 1 the partially crushed material forms a grinding bed 4, and dam rings 5 are fixed at each side of the grinding ring 1. In extension of the grinding ring 1 and outside the dam rings 5, there are fitted collecting jackets 6, to which scoop plates 7 are fixed. Guide plates 8 may be fitted at different locations in the mill to redirect the collected material to the grinding path. Stationary end sections 9 are fitted at the axial ends of the grinding ring.

Inlet ducts 11 and an outlet duct 12 for air/material suspension, all opening through the end sections 9, are shown by dotted lines. The material flow in the mill, i.e. the overflow of dammed material behind the roller 2, and the drop-off of material from the scoops 7, are illustrated by means of arrows. The rotational direction of the roller 2 and the grinding ring 1 are also illustrated by means of arrows.

When material is to be ground in the mill, the material is blown through the inlet ducts 11 in the stationary end sections 9 and directed under the roller 2 by means of guide plates 8 (shown by dotted lines in FIG. 1). Gradually as the amount of ground material after the roller is increased, the material flows over the dam rings 5.

When the material flows over the dam ring, it will land in the collecting jacket 6 to which the scoop plates 7 are fixed. The material will be carried upwards by the scoop plates and will, when these plates are tilted sufficiently, slide over the scoop plates and, by means of the guide plates 8 and the inwardly directed airstream which directs the material flow to the grinding ring 1, be distributed down over the roller 2 and the surface of the grinding ring 1.

The finish-ground material is discharged as an air/material suspension through the outlet ducts 12 through the stationary end sections 9 at both ends of the mill, and, if necessary, the material can subsequently be directed to a separator.

I claim:

1. A ring roller mill comprising at least one roller (2) within a respective grinding ring (1), at least one axial end of the grinding ring being fitted with a collecting jacket (6) for a coarse fraction and constituting an extension of the grinding ring (1) and with a stationary end section (9); radially inwardly directed scoop plates (7) fitted at intervals around the collecting jacket (6); means for rotating the collecting jacket (6) at a speed below the critical speed; an air inlet opening (11) in the stationary end section (9); and an outlet opening (12) in the stationary end section offset radially from the axis of the grinding ring (1) and aligned with the interior of the grinding ring (1) for a fine fraction to leave the mill in suspension; characterized in that there are two of the air inlet openings (11) located one on each side of the outlet opening (12) in the rotational direction of the grinding ring, the air inlet openings providing inlets for material to be ground.

2. A mill according to claim 1, wherein the scoop plates (7) and air inlet openings (11) are arranged so that, in use, material collected by, and falling from, the scoop plates (7) is blown back into the grinding ring by air blown in through the air inlets.

3. A mill according to claim 1, in which the scoop plates (7) are inclined backwardly relatively to the direction of rotation.

4. A mill according to claim 2, in which the scoop plates are inclined backwardly relatively to the direction of rotation.

5. A mill according to any one of claims 1, 2, 3 or 4, in which stationary guide plates (8) are fitted internally in the mill.

6. A mill according to any one of claims 1, 2, 3 or 4, in which collecting jackets (6) and end sections (9) provided with similar inlet and outlet openings (11,12) are located at both axial ends of the grinding ring (1).

7. A mill according to any one of claims 1, 2, 3 or 4, in which the outlet opening (12) in the or each end section (9) is formed in an area above the roller (2) where the distance between grinding ring (1) and roller (2) is greatest, and in that the air inlet openings (11) are symmetrically located relative to the or each outlet opening (12).

* * * * *